US007628581B2

(12) United States Patent
De Simone et al.

(10) Patent No.: US 7,628,581 B2
(45) Date of Patent: Dec. 8, 2009

(54) ROTATING MACHINE

(75) Inventors: Andrea De Simone, Ennetbaden (CH); Jonas Fältström, Aby (SE); Holger Kiewel, Brugg (CH); Thomas Kramer, Ennetbaden (CH); Markus Roland Wiebe, Freienwil (CH)

(73) Assignee: ALSTOM Technology Ltd., Baden (CH)

( * ) Notice: Subject to any disclaimer, the term of this patent is extended or adjusted under 35 U.S.C. 154(b) by 404 days.

(21) Appl. No.: 11/276,360

(22) Filed: Feb. 27, 2006

(65) Prior Publication Data

US 2006/0197400 A1 Sep. 7, 2006

(30) Foreign Application Priority Data

Mar. 3, 2005 (CH) ..... 0370/05

(51) Int. Cl.
*F04D 29/08* (2006.01)

(52) U.S. Cl. ..... 415/173.5; 415/173.6; 415/174.5; 416/219 R; 416/244 A

(58) Field of Classification Search ..... 415/173.5, 415/173.6, 174.5; 416/215, 219 R, 244 A
See application file for complete search history.

(56) References Cited

U.S. PATENT DOCUMENTS

| | | | | |
|---|---|---|---|---|
| 2,429,215 | A * | 10/1947 | Boestad | 416/219 R |
| 3,784,320 | A * | 1/1974 | Rossmann et al. | 416/215 |
| 3,881,844 | A * | 5/1975 | Hennessey et al. | 416/145 |
| 3,922,109 | A * | 11/1975 | Hagen | 416/213 R |
| 3,955,898 | A * | 5/1976 | Zaehring | 416/215 |
| 4,255,086 | A * | 3/1981 | Roberts | 416/218 |
| 4,813,850 | A * | 3/1989 | Partington | 416/219 R |
| 4,818,182 | A | 4/1989 | Bouru | |
| 5,110,262 | A * | 5/1992 | Evans | 416/219 R |
| 5,141,401 | A * | 8/1992 | Juenger et al. | 416/219 R |
| 6,237,558 | B1 | 5/2001 | Ergezen et al. | |
| 6,478,539 | B1 | 11/2002 | Trutschel | |

FOREIGN PATENT DOCUMENTS

| | | |
|---|---|---|
| EP | 0945594 | 9/1999 |
| EP | 1331362 | 7/2003 |
| GB | 2265671 | 10/1993 |

OTHER PUBLICATIONS

Search Report for Swiss Patent App. No. CH 3702005 (Apr. 19, 2006).

Search Report for European Patent App. No. 06110074.9 (May 29, 2006).

Nishitani, H., et al.,"Stress Concentration Factors for the Torsion of Shafts with a Circumferential Semi-elliptic Groove," Transactions of the Japanese Society of Mechanical Engineers (Japanese Society of Mechanical Engineers)—Nihon Kikai Gakkai Robbunshu (Nihon Kikai Gakkai), Bd. 43, Nr. 374, 1977, Seiten 3642-3650, Nihon Kikai Gakkai, Tokyo, JP, ISSN: 0387-5016.

Search Report from European Patent App. No. 06110074.9 (Aug. 18, 2008).

* cited by examiner

*Primary Examiner*—Igor Kershteyn
(74) *Attorney, Agent, or Firm*—Cermak Kenealy Vaidya & Nakajima LLP; Adam J. Cermak

(57) ABSTRACT

A rotating machine (10), in particular a compressor or turbine, has a rotor shaft (11) which is rotatable about an axis (20) and is provided with at least one slot (14). The mechanical stresses in the region of the slot are reduced in that the at least one slot (14) has a slot bottom (17) with an elliptic cross-sectional contour (24).

3 Claims, 2 Drawing Sheets

ROTATING MACHINE

This application claims priority to Swiss application No. 00370/05, filed 3 Mar. 2005, the entirety of which is incorporated by reference herein.

BACKGROUND OF THE INVENTION

1. Field of the Invention

The present invention relates to the field of rotating machines.

2. Brief Description of the Related Art

In the case of machines subjected to high thermal and mechanical load, such as, for example, compressors, gas turbines, or steam turbines, it is desirable to reduce mechanical stresses by means of a suitable design of the individual machine and plant parts.

Thus, for example, it is known from the prior art (see EP-A1-0 945 594 or U.S. Pat. No. B1-6,478,539), in the moving blades of gas turbines, to design the transition from the blade leaf to the adjoining blade platform lying below it with a predetermined, preferable elliptic curvature contour, the large major axis running in the radial direction and the small major axis being oriented parallel to the surface of the platform.

Furthermore, it is known from U.S. Pat. No. B1-6,237,558 to provide specific locations of the crankcase of an internal combustion engine which are critical in terms of mechanical stresses with a curvature which follows a conic section (ellipse, hyperbola, parabola).

Not only the moving blades of turbines are exposed to high mechanical loads due to the high rotational speed, but also the rotor shaft itself. Critical locations are in this case, above all, the slots in the rotor shaft which are arranged on the outer circumference and, running in the axial direction or running around annularly, may be provided, for example, for receiving the blade roots of the moving blades or as part of a shaft seal. Where such slots are concerned, the stresses occurring in the slots depend critically on the cross-sectional contour. GB-A-2 265 671 or U.S. Pat. No. 4,818,182 disclose, for the fastening of moving blades, slots which run around annularly and which have a rounded cross-sectional contour. No information is given as to the nature of the curved profile or the influence of the contour on the stresses in the slot.

SUMMARY OF THE INVENTION

An aspect of the present invention, therefore, includes configuring a rotating machine with a rotor shaft having slots, in such a way that the stresses in the slot region are markedly reduced.

It is particularly advantageous, in this context, that the at least one slot has a slot bottom with an elliptic cross-sectional contour. The slot may in this case run in the axial direction, as is the case in regard to the pine tree slots of compressor or turbine moving blades. The slot may, however, also be designed as a continuous annular slot or circumferential slot and likewise serve for the fastening of compressor or turbine moving blades.

According to a refinement of the invention, the at least one slot is a concentrically continuous annular slot, the large major axis of the ellipse running in the axial direction and the small major axis running in the radial direction.

A development of this refinement is distinguished in that the rotor shaft is surrounded concentrically, at a distance, by a stator, in that the at least one continuous annular slot is part of a shaft seal arranged between the stator and rotor shaft, and in that each continuous annular slot is assigned at least one sealing element which is fastened to the stator and which engages sealingly into the associated continuous annular slot in a manner of a labyrinth seal.

The sealing elements are in this case designed preferably as strip seals or brush seals.

A development of this refinement is distinguished in that the rotating machine is a compressor or turbine, in that the rotor shaft is provided for the reception of moving blades and in that the at least one continuous annular slot is designed for receiving and holding the roots of the moving blades. Preferably, undercuts for the retention of the blade root are arranged in the at least one continuous annular slot above the slot bottom.

BRIEF DESCRIPTION OF THE FIGURES

The invention will be explained in more detail below by means of exemplary embodiments, in conjunction with the drawing in which.

DETAILED DESCRIPTION OF EXEMPLARY EMBODIMENTS

Figure 1:
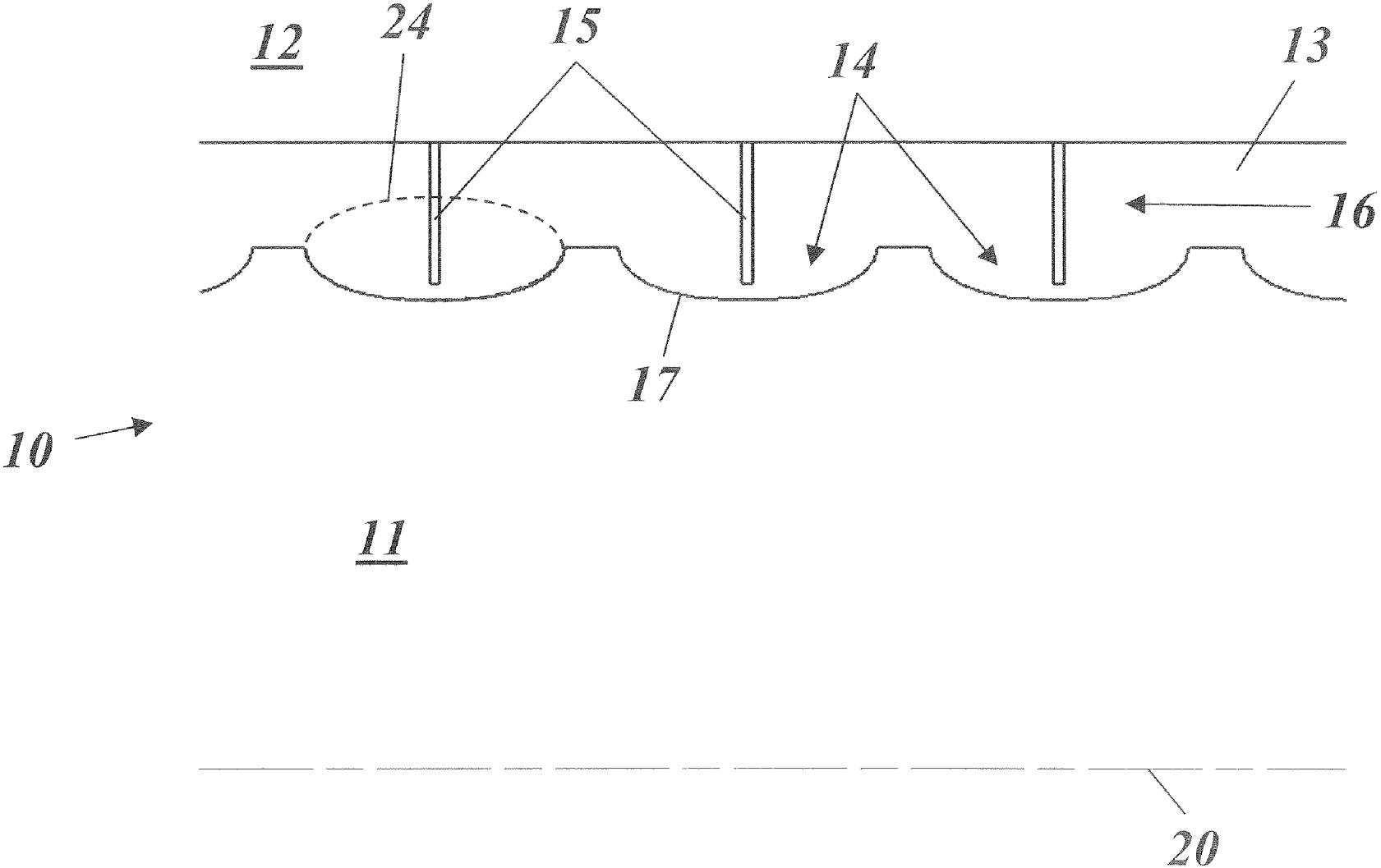
FIG. 1 shows, in the form of a detail, a longitudinal section through a rotating machine with a shaft seal according to one exemplary embodiment of the invention.

FIG. 1 reproduces, in the form of a detail, a longitudinal section through a rotating machine with a shaft seal according to one exemplary embodiment of the invention. The rotating machine 10, for example a compressor or a turbine, includes a rotor shaft 11 which is rotatable about an axis 20 and is surrounded concentrically, at a distance, by a stator 12. On account of the distance, an interspace remains between the rotor shaft 11 and the stator 12, which is sealed off in the axial direction against the throughflow of a fluid by means of a shaft seal 16. In this example, the shaft seal 16 is constructed in a manner of a labyrinth seal. It includes, on the outer circumference of the rotor shaft 11, a plurality of continuous annular slots 14 which are arranged one behind the other in the axial direction and into which sealing elements 15, projecting radially from the inner wall of the stator 12, sealingly penetrate. The sealing elements 15 may be, for example, sealing strips or brush seals. The annular slots 14 fundamentally weaken the mechanical strength of the rotor shaft 11. In order to avoid additional stresses due to the cross-sectional geometry of the annular slots 14, the slot bottom 17 of the annular slots 14 has an elliptic cross-sectional contour, that is to say the cross-sectional contour is part of an ellipse 24 which is depicted in FIG. 1 by dashes. The large major axis of the ellipse 24 is in this case oriented in the axial direction, and a small major axis in the radial direction. The result of this is that the curvature of the bottom contour of the slot bottom 17 has a minimum in the middle of slot bottom 17 (below the sealing element 15) and increases toward the edges of the annular slot in accordance with the ellipse equation. In the production of the annular slots 14, this contour profile is worked out of the rotor shaft 11 according to the ellipse equation.

Figure 2:
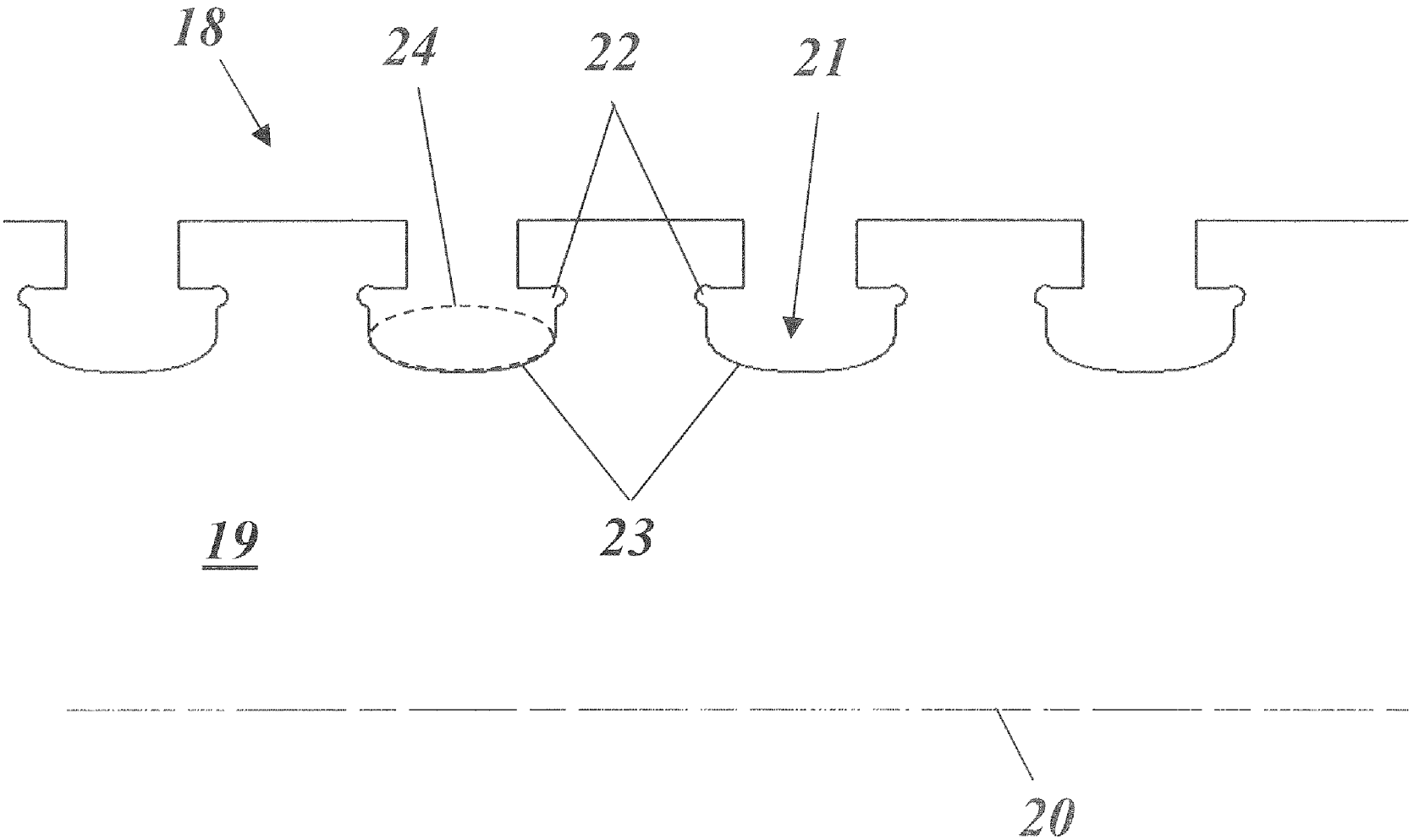
FIG. 2 shows, in an illustration comparable to FIG. 1, a turbine or compressor with slots running around annularly for receiving the roots of moving blades according to another exemplary embodiment of the invention.

Another exemplary embodiment of the invention is reproduced in FIG. 2 and relates directly to a turbine or a compressor. Here, too, the rotating machine 18 includes a rotor shaft 19 which in this case is designed for the fastening of moving blades. For this purpose, a plurality of deep continuous annular slots 21 are arranged one behind the other in the axial direction on the circumference of the rotor shaft 19 and are provided for receiving the roots of the moving blades, as is shown, for example, in the publication U.S. Pat. No. 4,818,182 mentioned initially. Each of the annular slots 21 is equipped at a predetermined depth with undercuts 22 located on both sides, on which the blade roots can be supported and retained counter to the centrifugal forces. Below the undercuts 22, the side walls of the annular slots 21 run vertically for a short distance and then merge into a slot bottom 23, the cross-sectional contour of which is likewise part of an ellipse 24 lying with the large major axis in the axial direction.

However, the provision of an elliptic bottom contour is not restricted only to a circumferential slot for moving blades, as illustrated in FIG. 2. It may also be used in the case of axial moving blade slots of the pine tree type, in order to reduce the mechanical stresses in the slot bottom.

LIST OF REFERENCE SYMBOLS

10, 18 rotating machine
11, 19 rotor shaft
12 stator
13 interspace
14, 21 annular slot (continuous)
15 sealing element (lamella, brush, etc.)
16 shaft seal
17, 23 slot bottom (elliptic)
20 axis
22 undercut
24 ellipse While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A rotating machine comprising:

a rotor shaft which is rotatable about an axis and includes at least one slot;

wherein the at least one slot comprises at least one concentrically continuous annular slot;

wherein the at least one concentrically continuous annular slot has a slot bottom with a continuous elliptic cross-sectional contour;

wherein the large major axis of the elliptic cross-sectional contour runs in the axial direction and the small major axis runs in a radial direction;

a stator which concentrically surrounds the rotor shaft at a distance;

a shaft seal arranged between the stator and the rotor shaft and comprising the at least one continuous annular slot; and at least one sealing element for each of said at least one continuous annular slot, which at least one sealing element is fastened to the stator and sealingly engages into the associated continuous annular slot to form a labyrinth seal.

2. The rotating machine as claimed in claim 1, wherein the at least one sealing element each comprises a strip seal or a brush seal.

3. A rotating machine comprising:

a rotor shaft which is rotatable about an axis and includes at least one slot;

wherein the at least one slot comprises at least one concentrically continuous annular slot;

wherein the at least one concentrically continuous annular slot has a slot bottom with a continuous elliptic cross-sectional contour;

wherein the large major axis of the elliptic cross-sectional contour runs in the axial direction and the small major axis runs in a radial direction;

wherein the rotor shaft comprises means for the reception of moving blades;

wherein the at least one continuous annular slot is configured and arranged to receive and hold roots of the moving blades;

undercuts for retaining a blade root, arranged in the at least one continuous annular slot above the slot bottom;

wherein said at least one concentrically continuous annular slot includes sidewalls below said undercuts which sidewalls extend vertically and merge into said slot bottom; and wherein the rotating machine comprises a compressor or a turbine.

* * * * *